US010562026B2

(12) United States Patent
Brettschneider et al.

(10) Patent No.: US 10,562,026 B2
(45) Date of Patent: Feb. 18, 2020

(54) DEVICE AND METHOD FOR HANDLING REAGENTS

(71) Applicant: Robert Bosch GmbH, Stuttgart (DE)

(72) Inventors: Thomas Brettschneider, Leonberg (DE); Christian Dorrer, Winnenden (DE)

(73) Assignee: Robert Bosch GmbH, Stuttgart (DE)

( * ) Notice: Subject to any disclaimer, the term of this patent is extended or adjusted under 35 U.S.C. 154(b) by 470 days.

(21) Appl. No.: 15/033,952

(22) PCT Filed: Oct. 16, 2014

(86) PCT No.: PCT/EP2014/072245
§ 371 (c)(1),
(2) Date: May 3, 2016

(87) PCT Pub. No.: WO2015/062875
PCT Pub. Date: May 7, 2015

(65) Prior Publication Data

US 2016/0263573 A1 Sep. 15, 2016

(30) Foreign Application Priority Data

Nov. 4, 2013 (DE) ..... 10 2013 222 283

(51) Int. Cl.
*B01L 3/00* (2006.01)

(52) U.S. Cl.
CPC ..... *B01L 3/50273* (2013.01); *B01L 2300/087* (2013.01); *B01L 2300/0816* (2013.01);
(Continued)

(58) Field of Classification Search
CPC ..... B01L 3/50273; B01L 2300/087
See application file for complete search history.

(56) References Cited

U.S. PATENT DOCUMENTS 5,580,523 A * 12/1996 Bard ..... B01J 19/0093 210/198.2
2006/0013726 A1 1/2006 Munenaka
(Continued)

FOREIGN PATENT DOCUMENTS

CN 101282789 A 10/2008
CN 101410699 A 4/2009
(Continued)

OTHER PUBLICATIONS

International Search Report corresponding to PCT Application No. PCT/EP2014/072245, dated Mar. 6, 2015 (German and English language document) (5 pages).

*Primary Examiner* — Lyle Alexander
*Assistant Examiner* — Dwan A Gerido
(74) *Attorney, Agent, or Firm* — Maginot, Moore & Beck LLP

(57) ABSTRACT

A device, especially a microfluidic device for performance of an immunoassay, has a first, a second and a third fluidically connected chamber and a membrane. In the event of a given deflection of the membrane into the first chamber, a first fluid is passed at least partly out of the first chamber into the second chamber in such a way that a second fluid is at least partly displaced from the second chamber into the third chamber in such a way that the third chamber is entirely filled with the second fluid.

11 Claims, 7 Drawing Sheets

(52) U.S. Cl.
CPC ..... *B01L 2300/0867* (2013.01); *B01L 2300/0887* (2013.01); *B01L 2300/123* (2013.01); *B01L 2400/0475* (2013.01); *B01L 2400/0481* (2013.01)

(56) References Cited

U.S. PATENT DOCUMENTS

| | | | | |
|---|---|---|---|---|
| 2006/0201425 | A1* | 9/2006 | Kobrin | C23C 16/4402 118/715 |
| 2008/0026373 | A1* | 1/2008 | Rodionova | B01L 3/5027 435/6.18 |
| 2008/0260553 | A1 | 10/2008 | Ma et al. | |
| 2010/0186841 | A1 | 7/2010 | Mukaddam et al. | |

FOREIGN PATENT DOCUMENTS

| | | | |
|---|---|---|---|
| CN | 102814203 | A | 12/2012 |
| CN | 102814240 | A | 12/2012 |
| CN | 103648648 | A | 3/2014 |
| DE | 39 26 066 | A1 | 2/1991 |
| EP | 0 293 519 | A1 | 12/1988 |
| WO | 2006/136990 | A2 | 12/2006 |
| WO | 2007/110825 | A2 | 10/2007 |
| WO | 2011/094577 | A2 | 8/2011 |
| WO | 2013/007433 | A1 | 1/2013 |

* cited by examiner

DEVICE AND METHOD FOR HANDLING REAGENTS

This application is a 35 U.S.C. § 371 National Stage Application of PCT/EP2014/072245, filed on Oct. 16, 2014, which claims the benefit of priority to Serial No. DE 10 2013 222 283.1, filed on Nov. 4, 2013 in Germany, the disclosures of which are incorporated herein by reference in their entireties.

BACKGROUND

Immunoassays form a standard method in bioanalysis for the detection of an analyte from a normally liquid sample. These tests are normally based on the specific bond between an antibody and an antigen. Immunoassays are distinguished by repetition of a sequence of process steps. These steps usually comprise addition of a liquid to a detection area, interaction of the sample components present in the liquid with the detection element during a predefined time interval, and subsequent rinsing of the detection area with a washing liquid.

For the application in microfluidics, miniaturized devices, so-called "lab-on-a-chip" systems, are known, which permit an at least partially automated sequence of these steps. However, additional external pumps and externally connected valves are needed for the operation of this system.

SUMMARY

The disclosure relates to a device, in particular a microfluidic device, for carrying out an immunoassay, having a first, a second and a third fluidically connected chamber and a diaphragm. According to the disclosure, in the event of a predefined deflection of the diaphragm into the first chamber, a first fluid is led at least partly out of the first chamber into the second chamber in such a way that a second fluid is at least partly displaced out of the second chamber into the third chamber in such a way that the third chamber is entirely filled with the second fluid. The first fluid is, for example, a liquid, a gas or a gas mixture. It is of particular advantage that, as a result of the partial displacement according to the disclosure of the second fluid, preferably a sample liquid, the third chamber is entirely filled with the second fluid and thus a detection element preferably located in the third chamber comes into exclusive contact with the second fluid. The complete filling of the third chamber with the second fluid effects high effectiveness of an interaction of a device located there, in particular a sensor, with the second fluid, since, with the exception of a part which can be connected to the chamber, the device is surrounded completely by the second fluid.

In a particularly advantageous development of the disclosure, the predefined deflection of the diaphragm into the first chamber corresponds to a maximum possible deflection of the diaphragm, wherein the maximum possible deflection is predefined by a configuration of the first chamber. Thus, the situation is advantageously achieved in which, following the complete filling of the third chamber by the second fluid, the second fluid automatically comes to a standstill and, for a time period that can be predefined as desired, is able to enter into interaction with a detection element preferably located in the third chamber.

Preferably, the device according to the disclosure has a first fluidic feed line into the first chamber with a restrictor and/or a valve. Here, the first fluidic feed line is designed in such a way that the deflection of the diaphragm is carried out by applying pressure to the diaphragm via the first fluidic feed line. Advantageously, by means of the use of the valve, the time for which the pressure is applied to the diaphragm can be predefined and/or, via the use of the restrictor, the application of pressure can be delayed in a predefined way.

In a particularly preferred development of the disclosure, the device has a fourth and a fifth chamber, which are each connected fluidically to the third chamber. Here, the fourth chamber comprises a third fluid and a second fluidic feed line, which fourth chamber is configured in such a way that when pressure is applied by the second fluidic feed line, at least part of the third fluid is displaced out of the fourth chamber via the third chamber into the fifth chamber in such a way that a fluid located in the third chamber, in particular the second fluid, is displaced out of the third chamber into the fifth chamber. This has the advantage that the third chamber is completely cleaned of liquid located therein. The third fluid is preferably a washing liquid, for example water or a washing buffer used in biochemical assays. It is particularly advantageous if the application of pressure through the second fluidic feed line is maintained until the third fluid has been displaced completely out of the fourth chamber into the fifth chamber via the third chamber, since drying of the third chamber can thus also be achieved.

Preferably, the first and the second fluidic feed line are coupled to a common fluidic feed line, which leads into a region outside the device according to the disclosure. This has the advantage that only one interface, in particular a pneumatic external interface, has to be provided for the operation of the device according to the disclosure.

Preferably, the second fluidic feed line into the fourth chamber has a restrictor and/or a valve, which are designed to delay or temporarily to prevent at least partial displacement of the third fluid out of the fourth chamber when pressure is applied by the second fluidic feed line. Thus, a time constant for the displacement of the fluids from the fourth and the third chamber can advantageously be predefined.

In a further refinement of the disclosure, the third chamber has a third fluidic feed line with a restrictor and/or a valve. Here, the third fluidic feed line having the restrictor and/or the valve is designed to clean the third chamber of residues of fluids located in the third chamber by rinsing with a fourth fluid. This has the advantage that cleaning of the third chamber can be carried out at any time, independently of the other chambers and their filling levels. Thus, a defined initial state of the third chamber can be reproduced before each process step.

In a particularly advantageous development of the disclosure, the second and/or the fourth chamber are arranged in a separate module. Here, the module is detachably connected to the other part of the device according to the disclosure such that the second chamber is connected fluidically to the first chamber and the third chamber and/or the fourth chamber is connected fluidically to the third chamber. Such a modular structure is associated with a number of advantages. The device according to the disclosure can be reused in a straightforward way, wherein the fluids needed for the respective use of the device in the second and/or the fourth chamber in a modular design can be coupled up as part of the device according to the disclosure. Another advantage consists in the fact that the module together with the fluids put in can be replaced in a straightforward way and, if necessary, disposed of, for example in the event of storage lives of the fluids being exceeded. Furthermore, the module can be stored separately from the remainder of the device, for example in a refrigerator. A further advantage consists in the use of different production methods with different materials for the module and the remainder of the device, in particular where the pre-storage of the fluids in the module places particular requirements, for example with regard to the sealing, on the materials used.

According to a particularly advantageous development of the disclosure, the device has a plurality of first, second and fourth chambers as well as a third and fifth chamber, wherein in each case a first chamber is connected fluidically to the third chamber via a second chamber, and the fourth chambers and the fifth chamber are connected fluidically to the third chamber. This has the advantage that the following sequence of steps can be carried out for in each case a group comprising a first, a second and a fourth chamber. A fluid from a second chamber is led at least partly into the third chamber as a result of deflecting a diaphragm in a fluidically connected first chamber, and is then displaced out of the third chamber into the fifth chamber by a third fluid from one of the fourth chambers. As a result of this development of the disclosure, it is in particular possible to represent more complex immunoassays. Such immunoassays comprise a sequence of interactions of various fluids or components thereof with a sensor, with steps provided in between for cleaning the sensor.

The subject of the disclosure is also a method, in particular a method for performing an immunoassay with the device according to the disclosure, wherein in a first step an application of pressure to the diaphragm and, as a result, a deflection of the diaphragm into the first chamber is carried out, by which means the first fluid is led at least partly out of the first chamber into the second chamber and the second fluid is at least partly displaced out of the second chamber into the third chamber, so that the third chamber is entirely filled with the second fluid.

Preferably, in a second step of the method according to the disclosure, an application of pressure by the second fluidic feed line and a displacement associated therewith of at least part of the third fluid out of the fourth chamber into the fifth chamber via the third chamber is carried out, so that a fluid located in the third chamber, in particular, the second fluid is displaced out of the third chamber into the fifth chamber.

Preferably, in a third step of the method according to the disclosure, the application of pressure by the second fluidic feed line is continued until both the fluid located in the third chamber and the third fluid are displaced completely out of the third chamber into the fifth chamber.

BRIEF DESCRIPTION OF THE DRAWINGS

Exemplary embodiments of the disclosure are illustrated schematically in the drawings and explained in more detail in the following description.

In the drawings.

DETAILED DESCRIPTION

Figure 1:
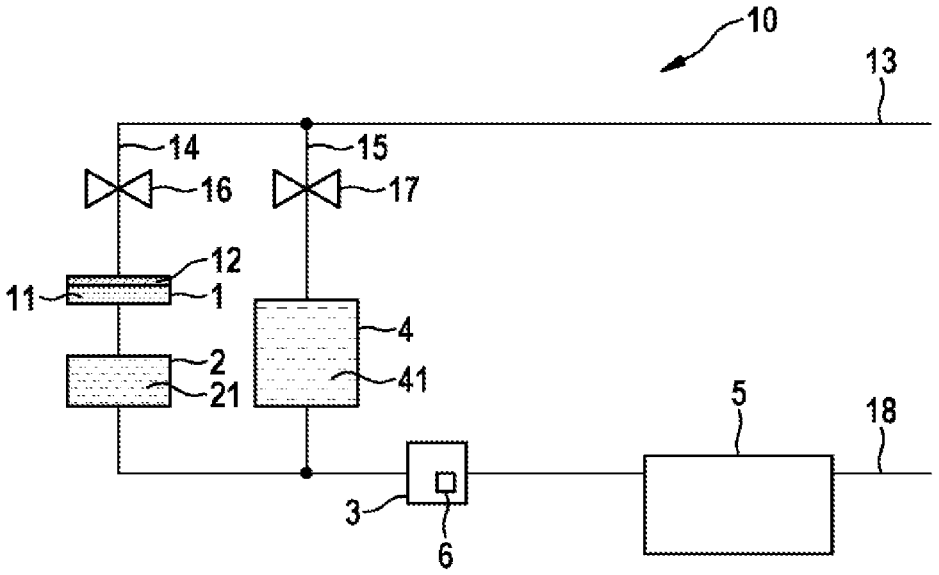
FIGS. 1 to 4 show an exemplary embodiment of the device according to the disclosure at different states during the performance of an immunoassay.

FIG. 1 shows an exemplary configuration of the device according to the disclosure. The device 10 has a first chamber 1, a second chamber 2 and a third chamber 3. There is a first fluid 11 in the first chamber 1 and a second fluid 21 in the second chamber 2. The first fluid 11 is, for example, a gas or a gas mixture, the second fluid 21 is preferably a liquid, which can contain sample components to be detected. The third chamber 3 can have a detection element 6, in particular a sensor for biological or chemical samples. The detection element can, for example, have a solid substrate with probes immobilized thereon, for example antigens or antibodies, wherein the detection can preferably be carried out optically, for example by measuring a fluorescent radiation, or electrically. The first chamber 1 is connected fluidically to the third chamber 3 via the second chamber 2. The device according to the disclosure also has a diaphragm 12, which is preferably arranged in the first chamber 1. In the event of a deflection of the diaphragm 12 into the chamber 1, at least part of the first fluid 11 is displaced out of the first chamber 1 into the second chamber 2, by which means the second fluid 21 is at least partly led out of the second chamber 2 into the third chamber 3.

Figure 2:
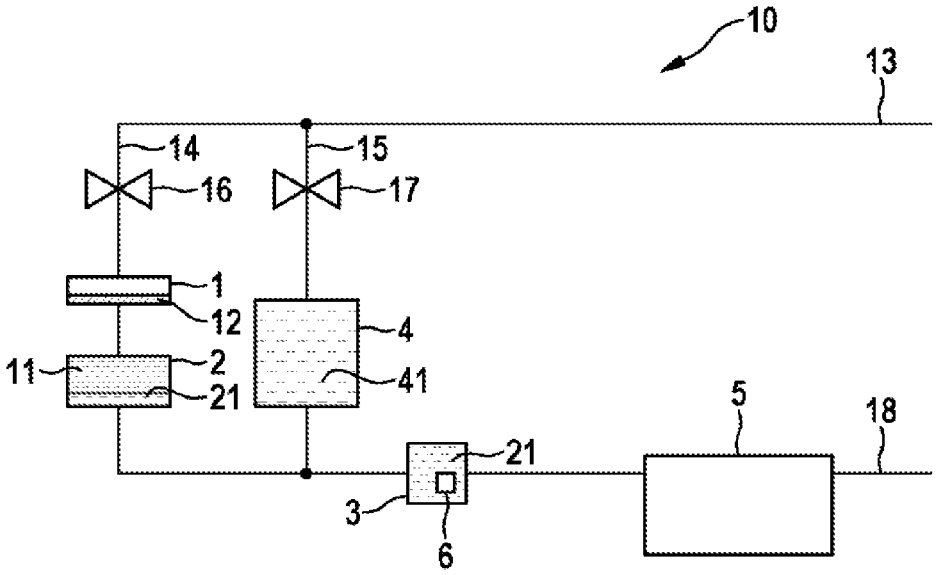

By means of an appropriately predefined size of the first chamber 1 in relation to the sizes of the second and third chamber 2, 3, the effect is that, in the event of a predefined deflection of the diaphragm 12 into the first chamber 1 via the displacement of the first fluid 11 out of the first chamber 1 into the second chamber 2, so much second fluid 21 from the second chamber 2 is displaced into the third chamber 3 that the third chamber 3 is entirely filled with the second fluid 21. This state of the device according to the disclosure is shown in FIG. 2. As is likewise shown in outline in FIG. 2, the predefined deflection of the diaphragm 12 into the first chamber 1 in this exemplary embodiment preferably corresponds to a maximum possible deflection of the diaphragm 12 into the first chamber 1, wherein the maximum possible deflection is predefined by a configuration of the first chamber 1. The deflection of the diaphragm 12 is preferably caused by an application of pressure into the first chamber 1 by a first fluidic feed line 14. Because of the limitation of a possible deflection of the diaphragm 12 into the first chamber 1, it is advantageously not necessary to change the application of pressure to the diaphragm 12 following the complete filling of the third chamber 3 by the second fluid 21. Since no further deflection of the diaphragm 12 is possible, the fluid 21 automatically comes to a standstill and the third chamber 3 remains filled with the second fluid 21.

In an advantageous development of the disclosure, the first fluidic feed line 14 has a first valve 16, by which means the application of pressure to the diaphragm 12 can be controlled over time. Alternatively or additionally to the first valve 16, the first fluidic feed line 14 can also comprise a restrictor 16, 22, in order in particular to temporarily delay an application of pressure to the first diaphragm 12.

In a particularly advantageous development of the disclosure, the device 10 according to the disclosure has a fourth chamber 4, which comprises a third fluid 41 and is connected fluidically to the third chamber 3. The third fluid 41 is, for example, water, a washing buffer or another cleaning agent. The fourth chamber 4 can preferably have pressure applied by a second fluidic feed line 15, so that at least part of the third fluid 41 is led out of the fourth chamber 4 into the third chamber 3. The second fluidic feed line 15 into the fourth chamber 4 can likewise comprise a valve 17 and/or a restrictor 17, 23 for controlling or delaying the application of pressure. It is particularly advantageous in this case if the first fluidic feed line 14 and the second fluidic feed line 15 are coupled to a common fluidic feed line 13, which leads into a region outside the device 10 according to the disclosure. Thus, only one external interface, for example a pneumatic connection, has to be provided to operate the device 10 according to the disclosure.

Figure 14:
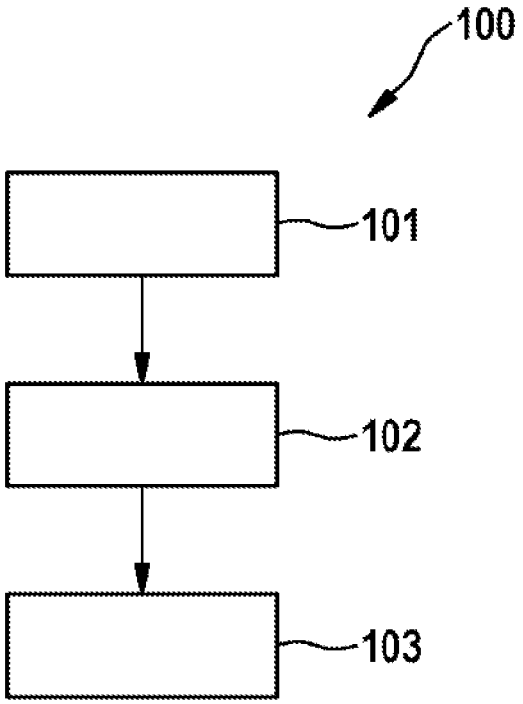
FIG. 14 shows a flow chart of the method according to the disclosure.

FIG. 14 shows a flow chart with exemplary process steps of the method 100 according to the disclosure with the device 10 according to the disclosure. Instantaneous recordings of the method sequence are also sketched in FIGS. 1 to 4. In FIG. 1, the first chamber 1 has the not yet deflected diaphragm 12 and the first fluid 11. The second chamber 2 and the fourth chamber 4 comprise the second fluid 21 and the third fluid 41, respectively. This corresponds to the initial situation of the method 100 according to the disclosure. In the first method step 101, an application of pressure is carried out and, as a result, a deflection of the diaphragm 12 into the first chamber 1, by which means the first fluid 11 is at least partly displaced into the second chamber 2 and, as a result, the second fluid 21 is at least partly led into the third chamber 3 and fills the latter entirely, as illustrated in FIG. 2. Preferably, the first method step 101 is triggered by opening the first valve 16 in the first fluidic feed line 14.

Figure 3:
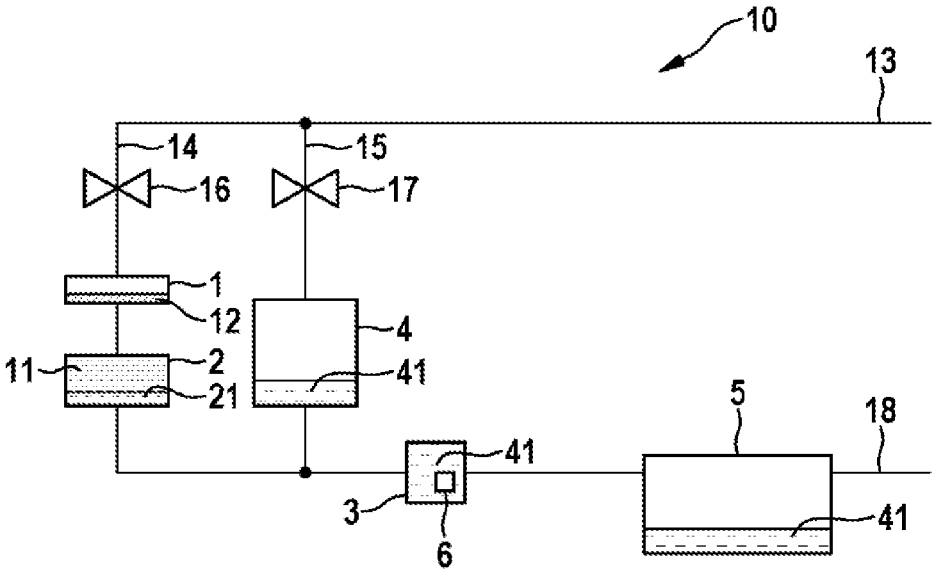
Figure 4:
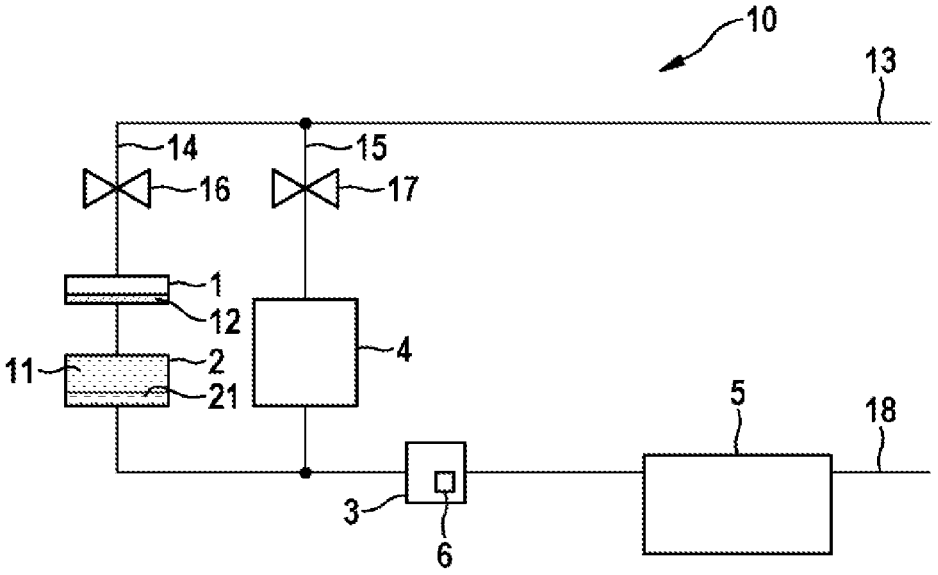

During a predefined time period, the second fluid 21 located in the third chamber 3 or sample components contained in the second fluid 21 are able to interact with a detection element 6 preferably arranged in the third chamber 3. Then, as illustrated in FIG. 3, in the second method step 102, as a result of an application of pressure by the second fluidic feed line 15, at least part of the third fluid 41 is led out of the fourth chamber 4 into the third chamber 3 in such a way that the second fluid 21 located in the third chamber 3 is displaced into the fifth chamber 5. FIG. 4 shows that, in the third method step 103, the application of pressure by the second fluidic feed line 15 is continued until all the fluid has been displaced out of the third chamber 3 into the fifth chamber 5. As a result, drying of the third chamber 3 can advantageously be achieved. In an advantageous development, the fifth chamber 5 has a first fluidic drain line 18, via which fluids located in the fifth chamber 5 can be led onward, in particular via an interface into a region outside the device 10 according to the disclosure.

Figure 5:
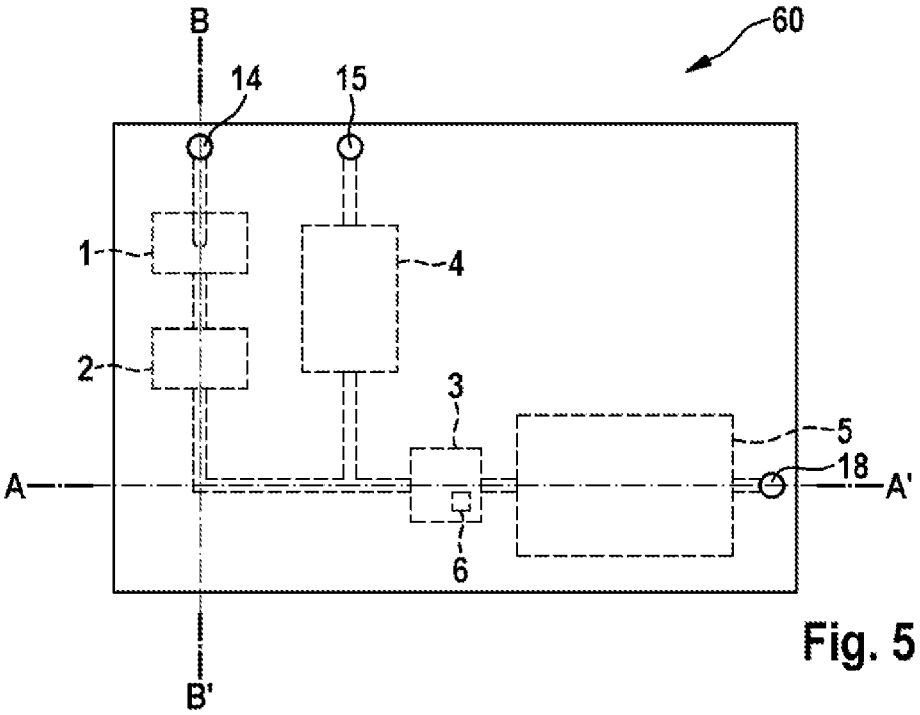
FIGS. 5 to 8 show an exemplary embodiment of the device according to the disclosure in the form of a layer structure.
Figure 6:
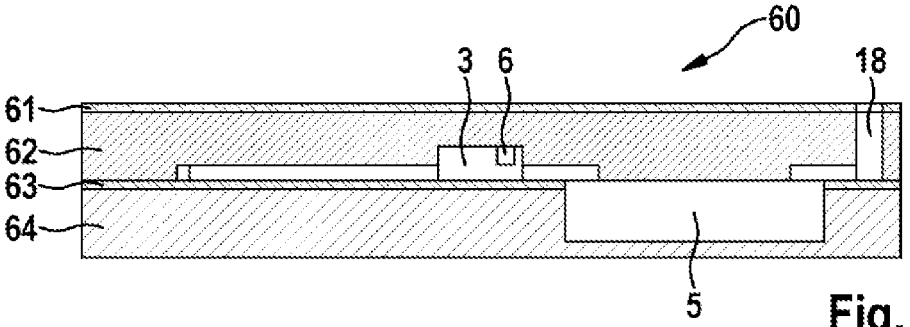
Figure 7:
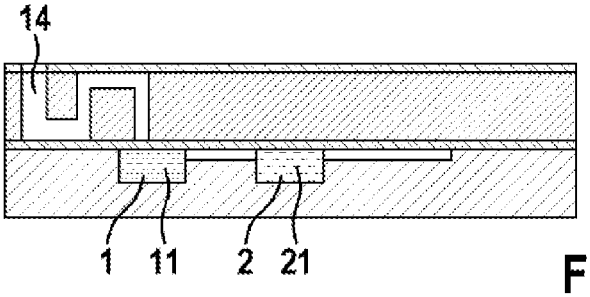
Figure 8:
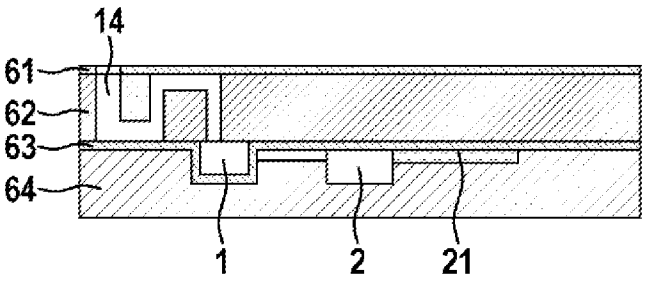

FIGS. 5 to 8 show an embodiment of the device 10 according to the disclosure as a layer system, wherein FIG. 5 represents a plan view and FIGS. 6 and 7 represent a section respectively along the section line AA' and BB' indicated in FIG. 5. The layer system 60 comprises a first polymer substrate 62, which is separated by a polymer diaphragm 63 from a second polymer substrate 64. A covering layer 61, for example likewise in the form of an adhesive film, can be applied to the side of the first polymer substrate 62 that is opposite the polymer diaphragm 63. For example, the first chamber 1 and the second chamber 2 are located in the form of recesses in the second substrate 64, while the third chamber 3 is provided with a sensor device 6, preferably arranged therein, in the first polymer substrate 62. Part of the polymer diaphragm 63 here serves as the diaphragm 12 which, in the event of the application of pressure by the first fluidic line feed line 14, expands into the first chamber 1 and in the process displaces the first fluid 11 at least partly into the second chamber 2. The second fluid 21 located in the second chamber 2 is thereby led at least partly into the third chamber 3. This state of the device 11 according to the disclosure is illustrated in FIG. 8. As illustrated in FIGS. 6 and 7, respectively, the fluidic feed lines 14, 15 and the first fluidic drain line 18 lead through the first polymer substrate 62 and the optional covering layer 61 into a region outside the device 60 according to the disclosure.

FIG. 7 shows by way of example the initial state of the method according to the disclosure when a layer system is used as the device 60 according to the disclosure. The first chamber 1 and the second chamber 2 are filled with the first fluid 11 and with the second fluid 21, respectively. FIG. 8 shows the state of the device 60 after the first method step 101 has been performed. The first fluid 11 has been led partially into the second chamber 2 by the deflection of the polymer diaphragm 63 into the first chamber 1 and, in the process, has displaced part of the second fluid 21 out of the second chamber 2.

The polymer substrates 62, 64 are preferably thermoplastics, for example polycarbonate (PC), polypropylene (PP), polyethylene (PE), polymethyl-methacrylate (PMMA), cyclic olefin polymer (COP), cyclic olefin copolymer (COC). The polymer diaphragm 63 is preferably an elastomer, in particular a thermoplastic elastomer, or a thermoplastic or a hot-seal film. The thickness of the polymer substrates 62, 64 is preferably 0.1 mm to 1 cm, the thickness of the polymer diaphragm 62 is preferably 0.005 to 0.5 mm. The lines or channels connecting the fluidic chambers preferably have a diameter from 0.2 to 3 mm. The volumes of the chambers are preferably 0.005 to 5 ml. The covering layer 61 preferably has a thickness between 0.01 and 0.2 cm.

Figure 9:
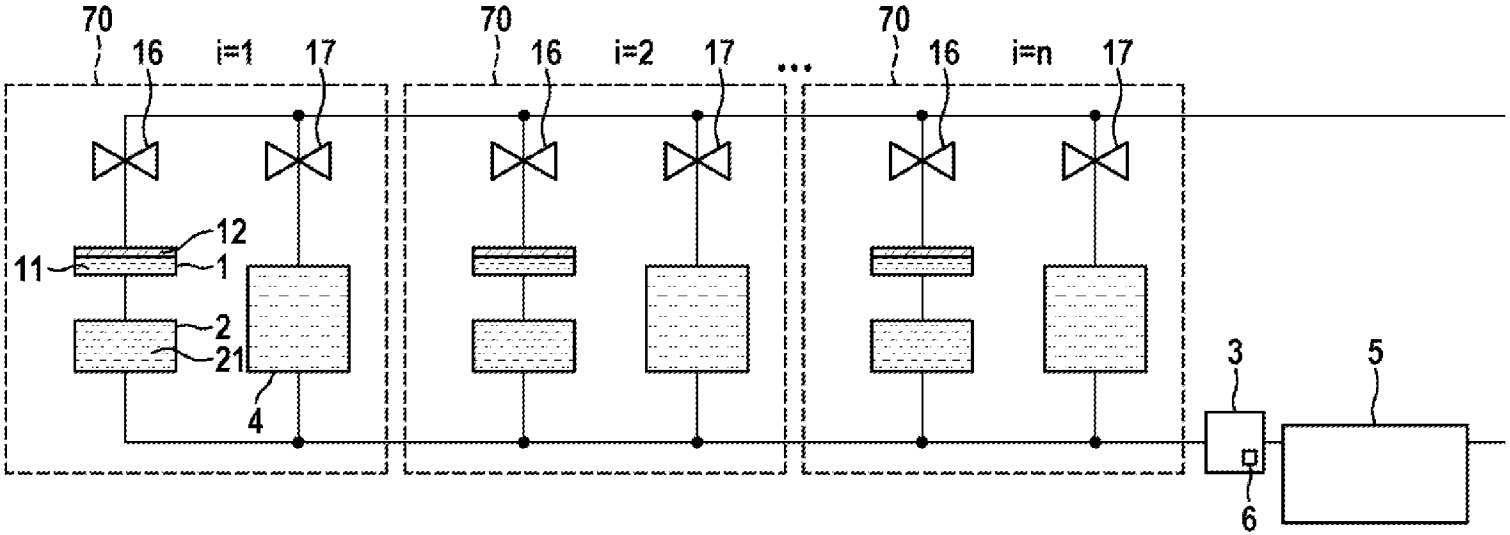
FIGS. 9 and 10 show preferable developments of the device according to the disclosure.

FIG. 9 shows an embodiment of the device 10 according to the disclosure, wherein the device 10 has a plurality of first, second and fourth chambers 1, 2, 4 as well as a third and a fifth chamber 3, 5. In each case one first chamber 1 is connected fluidically to the third chamber 3 via a second chamber 2. The fourth chambers 4 and the fifth chamber 5 are likewise connected fluidically to the third chamber 3. In each case a first chamber 1 with a deflectable diaphragm 12, a second chamber 2 and a fourth chamber 4 form a scalable unit 70. Optionally, the unit 70 comprises additional valves or restrictors 16, 17, 22, 23. Such a unit 70 respectively permits the feeding of a second fluid 21, which for example can contain sample components to be detected or substances needed to perform the assay, for example antibodies, and then the feeding of a third fluid 41, in particular a cleaning fluid, to a device arranged in the third chamber 3, for example a detection element 6. This permits a sequence of a plurality of steps alternating with one another of feeding fluids to be examined or other substances needed for the performance of the assay to a detection element 6 in the third chamber 3 and a subsequent cleaning operation of the detection element 6 with washing liquids from the respective fourth chamber 4. The integration of a multiplicity of these units 70 is indicated in FIG. 9 by the representation of n units 70, where n represents a natural number. Preferably, all the fluidic feed lines 14, 15 in the respective first and fourth chambers 1, 4 are connected to a common fluidic feed line 13, which can be coupled via an interface to a region outside the device 10. In particular, the second chamber 2 of the first unit 70 (i=1) can comprise a sample to be examined, and the further second chambers 2 of the units 70 for i=2 to i=n can comprise other substances needed for the assay, for example antibodies. Thus, by means of an integration of multiple such units 70 into the device 10, the performance of more complex immunoassays is also possible.

Figure 10:
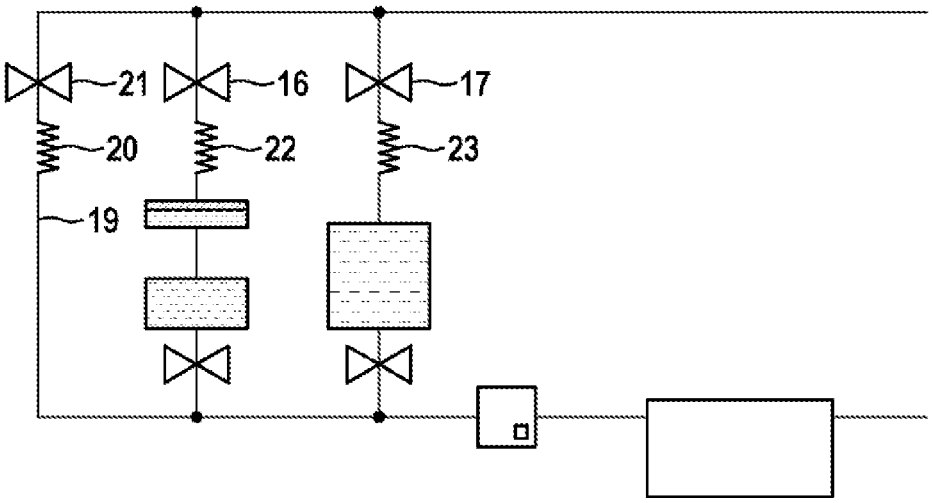

FIG. 10 shows a further advantageous embodiment of the disclosure, which has an additional third fluidic feed line 19 into the third chamber 3. This feed line 19 is preferably likewise coupled to a common feed line 13 and has a restrictor 20 and/or a valve 21. By means of the third fluidic feed line 19 it is possible to rinse the third chamber 3 with a fluid and, as a result, to clean the same of other fluids and to dry it irrespective of the filling levels of the other chambers, the feed lines of which are preferably likewise provided with valves 16, 17 and restrictors 22, 23. Thus, a defined initial state of the third chamber 3 can be reproduced before each process step.

Figure 11:
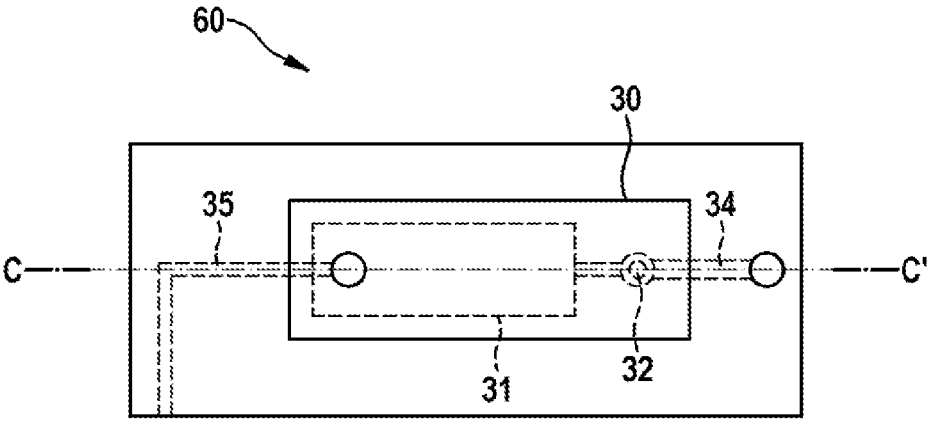
FIGS. 11 to 13 show embodiments of the device according to the disclosure in a modular design.
Figure 12:
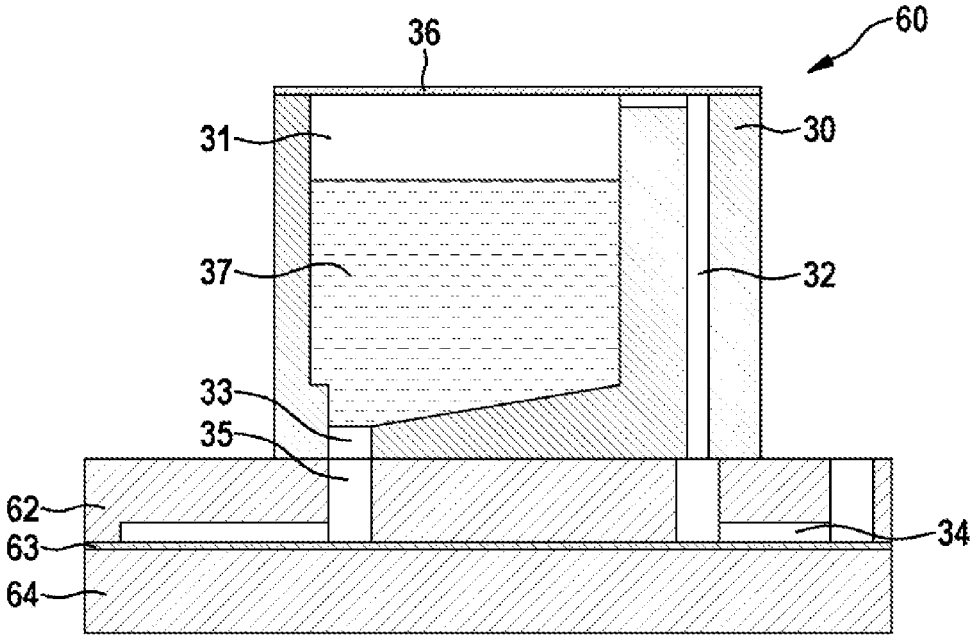
Figure 13:
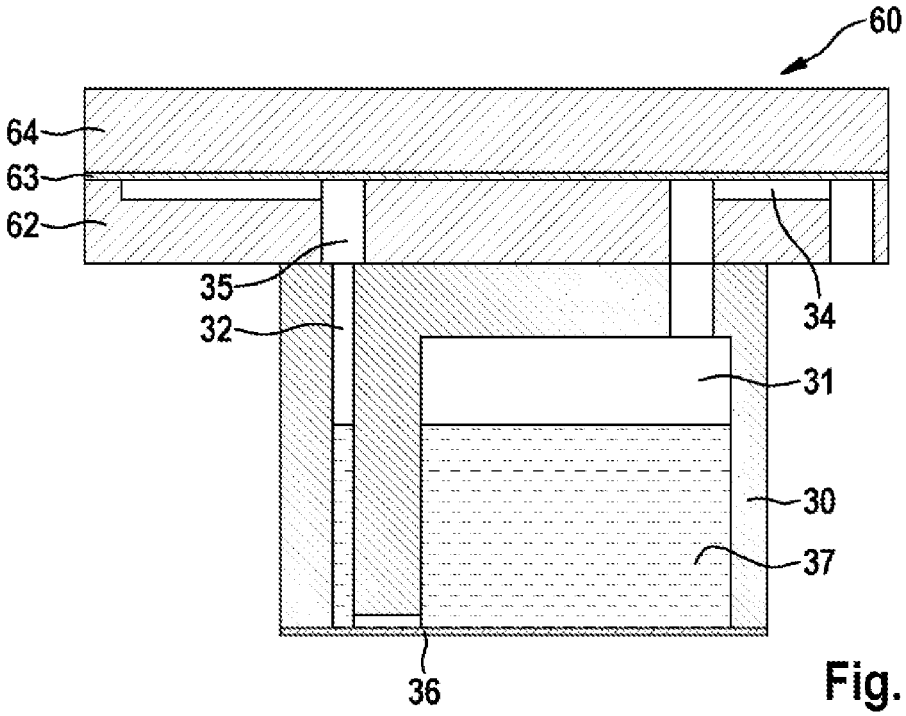

FIGS. 11, 12 and 13 show further embodiments of the device 60 according to the disclosure in the layer structure, wherein the second chamber 2 and/or the fourth chamber 4 are arranged in a separate module 30. The module 30 can be detachably connected to the device 60, wherein, by means of suitably placed channels, the chambers 2, 4 in the module 30 can be brought into fluidic contact with the other chambers of the device 60. The connection between the module and the device 60 can be made, for example, by a plug-in connection, in particular a Luer lock known from the medical sector, and sealed off by O-rings.

FIG. 11 shows a plan view of an embodiment of the device 60 according to the disclosure with a separate module 30, and FIG. 12 shows an associated sectional view according to the section line CC' drawn in FIG. 12. The module 30 has a fluid chamber 31, which can be the second chamber 2 or the fourth chamber 4. The fluid chamber 31 is connected fluidically via first and second fluid channels 32, 33 to third and fourth fluid channels 34, 35 in the device 60. A lid 36, which is preferably re-closable for the purpose of topping up, closes off the fluid chamber 31 in a fluid-tight manner. By means of an application of pressure via the first fluid channel 32, a fluid 37 located in the fluid chamber 31 can be conveyed into the device 60. Since the opening of the first fluid channel 32 into the fluid chamber 31 is preferably arranged to be higher than the opening of the second fluid channel 33 in relation to the direction of gravity, when pressure is applied by the first fluid channel 32, the fluid 37 located in the fluid chamber 31 can advantageously be led into the third fluid channel 35 of the device 60 via the second fluid channel 32 in a bubble-free manner by utilizing the force of gravity.

FIG. 13 shows an analogous sectional view according to the section line CC' drawn in FIG. 11, wherein, in this embodiment, the module 30 is detachably connected to the underside of the device 60 in relation to the direction of gravity. This advantageously has the effect that, because of the force of gravity, even without using valves in the fluid channels, no fluid 37 can penetrate into the device 60 from the fluid chamber 31 in an uncontrolled manner.

The invention claimed is:

1. A device configured to carry out an immunoassay, the device comprising:

a first chamber;

a second chamber;

a third chamber fluidically connected to the first chamber and the second chamber; and a diaphragm operatively connected to the first chamber, wherein the diaphragm and the third chamber are configured such that when a predefined deflection of the diaphragm into the first chamber occurs, a first fluid is led at least partly out of the first chamber into the second chamber such that a second fluid is at least partly displaced out of the second chamber into the third chamber such that the third chamber is entirely filled with the second fluid.

2. The device as claimed in claim 1, wherein:

the predefined deflection of the diaphragm into the first chamber corresponds to a maximum possible deflection of the diaphragm, and the maximum possible deflection is predefined by a configuration of the first chamber.

3. The device as claimed in claim 1, further comprising:

a first fluidic feed line into the first chamber including at least one of a restrictor and a valve, wherein the first fluidic feed line is configured such that the deflection of the diaphragm is carried out by applying pressure to the diaphragm via the first fluidic feed line.

4. The device as claimed in claim 1, wherein:

the third chamber has a third fluidic feed line with at least one of a restrictor and a valve, and the third fluidic feed line having the at least one of the restrictor and the valve is configured to clean the third chamber of residues of fluids located in the third chamber by rinsing with a fourth fluid.

5. The device as claimed in claim 1, further comprising:

a fourth chamber and a fifth chamber, each of which is connected fluidically to the third chamber, wherein:

the fourth chamber includes a third fluid and has a second fluidic feed line, and the fourth chamber is configured such that, when pressure is applied by the second fluidic feed line, at least part of the third fluid is displaced out of the fourth chamber via the third chamber into the fifth chamber such that a fluid located in the third chamber, is displaced out of the third chamber into the fifth chamber.

6. The device as claimed in claim 5, wherein:

the second fluidic feed line into the fourth chamber has at least one of a restrictor and a valve, and the at least one of the restrictor and the valve is configured to delay or temporarily to prevent at least partial displacement of the third fluid out of the fourth chamber when pressure is applied by the second fluidic feed line.

7. The device as claimed in claim 5, wherein:

at least one of the second chamber and the fourth chamber is arranged in a separate module, and the module is detachably connected to the device such that the second chamber is connected fluidically to the first chamber and the third chamber and/or the fourth chamber is connected fluidically to the third chamber.

8. The device as claimed in claim 5, wherein the fourth chamber is configured such that, when pressure is applied by the second fluidic feed line, at least part of the third fluid is displaced out of the fourth chamber via the third chamber into the fifth chamber such that the second fluid is displaced out of the third chamber into the fifth chamber.

9. A device configured to perform an immunoassay, the device comprising:

a plurality of first chambers;

a plurality of second chambers configured to receive fluid from the plurality of first chambers;

a plurality of fourth chambers, each of the plurality of fourth chambers providing a bypass around the plurality of first and second chambers;

a third chamber configured to receive fluid from each of the plurality of second and fourth chambers; and a fifth chamber configured to receive fluid from the third chamber, wherein:

each first chamber of the plurality of first chambers is connected fluidically to the third chamber via a corresponding second chamber of the plurality of second chambers; and each fourth chamber of the plurality of fourth chambers is connected fluidically to the third chamber.

10. The device of claim 9, wherein the plurality of first and fourth chambers are configured to receive fluid from a common fluidic feed line.

11. The device of claim 9, wherein the plurality of second and fourth chambers are configured to discharge fluid into a common inlet line.

* * * * *